United States Patent [19]

Ishizuka et al.

[11] 4,329,129

[45] May 11, 1982

[54] VANED ROTOR FOR ROTARY MECHANISMS WITH BEARINGS IN VANE SLOTS

[75] Inventors: Yutaka Ishizuka, Higashimatsuyama; Shinichi Kobayashi, Kawagoe, both of Japan

[73] Assignee: Robert Bosch GmbH, Stuttgart, Fed. Rep. of Germany

[21] Appl. No.: 94,664

[22] Filed: Nov. 15, 1979

[30] Foreign Application Priority Data

Nov. 22, 1978 [JP] Japan ..... 53/161155[U]

[51] Int. Cl.[3] ..... F01C 21/02

[52] U.S. Cl. ..... 418/138; 418/235

[58] Field of Search ..... 418/136, 138, 235

[56] References Cited

U.S. PATENT DOCUMENTS 2,448,233 8/1948 Nyborg ..... 418/235

2,562,698 7/1951 Clerc ..... 418/235

FOREIGN PATENT DOCUMENTS 209716 7/1940 Switzerland ..... 418/235

324414 1/1930 United Kingdom ..... 418/136

*Primary Examiner*—John J. Vrablik

*Attorney, Agent, or Firm*—Michael J. Striker

[57] ABSTRACT

An improved rotor is disclosed, for use with movable vanes in pumps, compressors and the like. The rotor is equipped with slots in which the vanes are located. Each slot has a leading surface and a trailing surface. Two embodiments of this invention are taught. In one embodiment, a groove is cut into the trailing surface of each slot, so that a specially designed rod-like bearing may be interposed between the rotor and the vane to reduce friction between the trailing face of the vane and the trailing surface of the rotor. In the other embodiment, an additional groove is cut in the leading face of the vane so that a similar bearing may be interposed between the leading face of the vane and the leading surface of the slot. As a result of these designs, friction between the vane and the rotor is much reduced, and a substantially longer work-life results.

6 Claims, 7 Drawing Figures

VANED ROTOR FOR ROTARY MECHANISMS WITH BEARINGS IN VANE SLOTS

BACKGROUND OF THE INVENTION

1. Field of the Invention

This invention pertains to pumps, compressors and the like. More specifically, this invention pertains to such pumps and/or compressors which utilize movable vanes which are slidably located within slots in a rotating rotor and which move up and down within the rotor in response to the curvature of an enclosing, circumferential cylinder wall.

2. Description of Prior Art

Many pumps and compressors are known which utilize movable vanes. In these devices, the vanes are forced outwardly by centripetal acceleration resulting from the rotation of a central rotor. These vanes move outwardly until they touch a cylinder wall. Because the wall is of a non-circular shape, the vanes are forced inwardly when the wall approaches the rotor and can move outwardly when the wall moves away from the rotor. In these devices, it is necessary to provide a small amount of clearance between the vane and the rotor in order to allow the vane to slide inwardly and outwardly. Because of the pressures resulting from the fluids which are compressed and/or pumped, the vanes, when in actual use, do not actually lie parallel to the walls of the slots in which they move. Rather, these vanes are forced rearwardly so that their trailing faces abut the trailing surfaces of the slots. As a result of this inclination of the vanes with respect to the slots, the trailing edge of each slot is forced against the trailing face of the corresponding vane.

This phenomenon results in friction, and consequently results in substantial abrasion of either the vane or the rotor. After such abrasion has continued, the play between the vane and the rotor becomes too great, and the pump or compressor must be disassembled and serviced.

Conventionally, this problem has been attacked by using greases and oils on the faces of the vane and/or the surfaces of the rotor. Although this lubrication has been somewhat successful, the underlying problem, namely frictional contact between the trailing edge of the rotor and the trailing face of the vane, still exists and still remains desirable.

SUMMARY OF THE INVENTION

It is an object of this invention to provide an improved rotor and an improved mechanism for use in such pumps and compressors, which will reduce friction between the movable vanes and the rotor which holds them, in order to increase the work life of the assembly and result in more durable pumps and compressors which do not have to be serviced frequently.

In order to accomplish this purpose, two embodiments of the invention are taught. In the first embodiment, a groove is cut into the trailing surface of each slot in the rotor. The groove has a surface which is an arc of a circle. A semi-circular bearing, made of suitable material, is rested within the groove and the flat surface of the bearing abuts the trailing face of the vane. The groove is so located that the trailing face of the vane will never touch the trailing edge of the slot. Moreover, because the bearing can rotate within its groove, there is only minimal friction associated with the introduction of the bearing.

In the second embodiment of the invention, a similar bearing is installed in the leading face of the vane to bear against the leading surface of the slot. In this second embodiment, there is no frictional engagement between the vane and the leading surface of the rotor, which results in even less wear than in the first embodiment.

These bearings effectively increase the contact area between each vane and the rotor which holds it, which in turn distributes the forces on the vane over a larger surface area and hence reduces the abrasion of the vane and the rotor. Hence, this invention results in an improved pump and compressor, which requires less servicing and has less down-time than pumps and compressors taught by the prior art.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
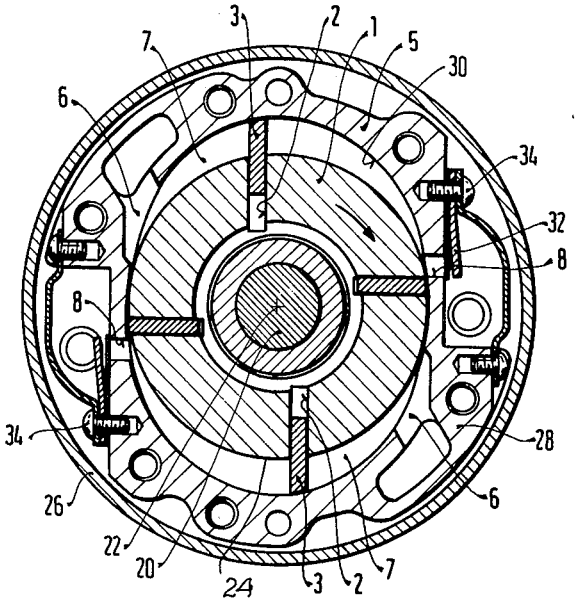
FIG. 1 PRIOR ART
FIG. 1 shows a cross-sectional elevation of a compressor which is constructed according to the principle taught by the prior art.

Referring first to FIG. 1, it can be seen that rotor 1 is mounted on shaft 20 with axis 22. It can be seen that when the shaft 20 is rotated in a clockwise sense as viewed in FIG. 1, that the rotor will move in the direction of the arrow marked thereon. The rotor has a circumferential surface 24 which circulates around the axis 22. Although the circumferential surface is shown in FIG. 1 to be cylindrical in shape, FIG. 1 is not intended to be limiting in this sense and circumferential surface 24 may have any other shape in which the device will operate.

Extending inwardly, toward the center of the rotor, are four straight slots 2. It can be seen in FIG. 1 that these slots are located at regular intervals around the circumferential surface 24. Although four such slots are shown, any suitable number of slots may be used. Additionally, it is to be noted that the slots 2 are offset so that they do not lie along radii of the rotor. Again, this is to be taken only in a descriptive sense, and the slots may be oriented to any suitable position relative to the rotor.

Each slot holds a slidable vane 3 which is generally rectangular in shape. As can be seen in FIG. 1, the vanes can slide inwardly and outwardly relative to axis 22 during the operation of the compressor.

Surrounding the rotor 1 and the vanes 3 carried thereby, is a cylindrical housing 26 to which a cylinder 28 is attached. The cylinder 28 has a cylinder wall 30 which is generally elliptical in cross-section, and the cylinder wall 30 is interrupted by two intake ports 6 and two exhaust ports 8 which are spaced apart from each other. It can be seen in FIG. 1 that the two intake ports 6 are diametrically opposed to each other, as are the exhaust ports 8. It should be noted once again that the number of intake and exhaust ports shown may be varied, as long as each intake port has a corresponding exhaust port and vice versa. Each exhaust port 8 has a check valve 32 associated with it. In FIG. 1, these check valves are shown to be spring loaded flaps which are secured to the cylinder 28 by screws 34, but any suitable check valve may be used.

It may be seen from FIG. 1 that the circumferential surface 24 and the cylinder wall 30 bound two opposed enclosed volumes 7. The distances between cylinder wall 30 and circumferential surface 24 approach a minimum immediately before each intake port 6 and immediately before each exhaust port 8, remaining at that minimum value between each adjacent intake port 6 and exhaust port 8. Between these regions of minimum clearance between the rotor 1 and the cylinder 28, the enclosed volumes 7 assume maximum thickness.

It may now be seen that when the rotor 1 is rotated in a clockwise sense as viewed in FIG. 1, a fluid (which may be a liquid or a gas or a mixture of both) is introduced into the enclosed volume 7. As a vane 3 passes each intake port 6, the fluid therefrom is pushed ahead of the vane 3 and subsequently compressed as the vane approaches an exhaust port 8. The fluid, after having been compressed to some predetermined pressure, forces the check valve 32 of the exhaust port 8 which is associated with the intake port 6 open to allow the fluid to be forced out of the enclosed volume 7 through exhaust port 8 and then delivered to some outside location (not shown) for use there. The check valve 32 insures that no fluid flow in a reverse direction will occur.

Figure 2:
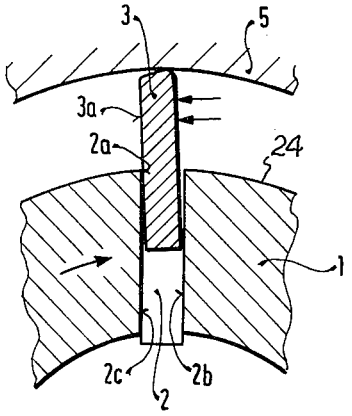
FIG. 2 PRIOR ART
FIG. 2 shows a detail view of a portion of FIG. 1, showing the actual position of the vane in a slot during actual use.

As is shown in FIG. 2, each vane 3 is actually slightly smaller than the slot 2 which holds the vane in place. As can be seen in FIG. 2, the pressure of the compressed fluid, shown in FIG. 2 by two closely-spaced arrows, forces the vane rearwardly with respect to the rotor 1 and causes the trailing face 3*a* of the vane to press against trailing edge 2*a* of the rotor slot 2. This pressure thus introduces large frictional forces between the trailing surface 2*c* of the slot 2 and the trailing face 3*a* of the vane 3, since the trailing edge 2*a* is comparatively sharp and any force on the vane is transmitted to a minimal surface area thereof. It may be seen from FIG. 2 that as the device is operated for long periods of time, the inward and outward movement of the vane 3 relative to the rotor 1 will cause the trailing face 3*a* of the vane 3 and/or the trailing edge 2*a* of the rotor 1 to be abraded by friction. This will increase the clearance between the vane 3 and the rotor 1 until the clearance becomes too large, at which point the compressor will have to be taken apart for servicing. It has been found that this problem continues to exist even if grease or oil is applied to the faces of the vane 3 or the surfaces of the slot 2.

Figure 3:
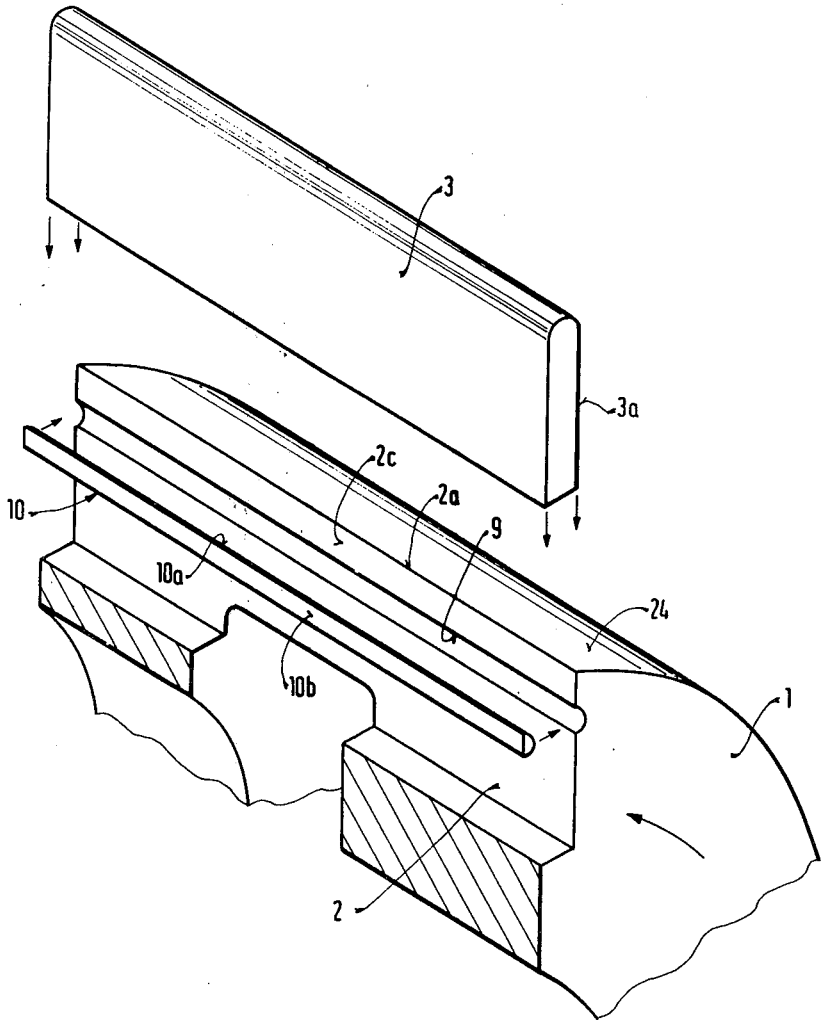
FIG. 3 is an exploded perspective view of the first embodiment of the invention.

As is shown in FIG. 3, this problem is attacked by cutting a trailing groove 9 in the trailing surface 2*c* of the rotor 1. The trailing groove 9 has a cross-section which takes on the shape of a segment of a circle which is smaller than a semi-circle of that circle. It will be noted from FIG. 3 that the trailing groove 9 is oriented parallel to the axis 22 of the device.

A trailing bearing, generally indicated by reference number 10, is placed in trailing groove 9. It can be seen in FIG. 3 that trailing bearing 10 is an elongated element which has a semi-circular cross-section, which causes trailing bearing 10 to have a curved surface 10*a* and a flat surface 10*b*. The curved surface 10*a* of the trailing bearing thus abuts the interior of trailing groove 9, and trailing bearing 10 is thus free to rotate within trailing groove 9. On the other hand, flat surface 10*b* of the trailing bearing 10 rests against trailing space 3*a* of vane 3.

Figure 4:
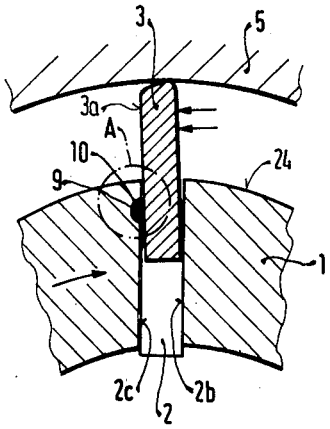
FIG. 4 is a cross-sectional elevation of a portion of a compressor which embodies this invention.
Figure 5:
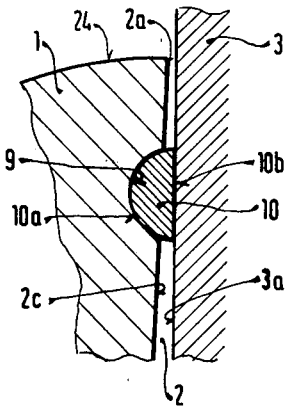
FIG. 5 is a detail view of that portion of FIG. 4 which is enclosed by a circle labelled A on FIG. 4.

At this point, it is important to stress the locations of and the dimensions of trailing groove 9 and trailing bearing 10 relative to the rotor 1. Trailing groove 9 is located comparatively close to circumferential surface 24. Moreover, it will be noted that because the circular segment of trailing groove 9 is smaller than the semicircular configuration of trailing bearing 10, that flat face 10*b* protrudes very slightly from trailing surface 2*c*. The relative sizes of trailing groove 9 and trailing bearing 10 are so chosen, that when flat surface 10*b* is parallel to trailing surface 2*c*, the distance between them will be at most equal to 0.003 millimeters. Thus, it can be seen from FIGS. 4 and 5 that trailing edge 2*a* of rotor 1 will never touch trailing face 3*a* of the vane 3 while the device is operated. As can be seen in these drawings, the force which in the prior art was all directed against trailing edge 2*a* is now spread all across flat surface 10*b*, which results in a vastly decreased pressure per unit area of contact and thus reduces friction.

Figure 6:
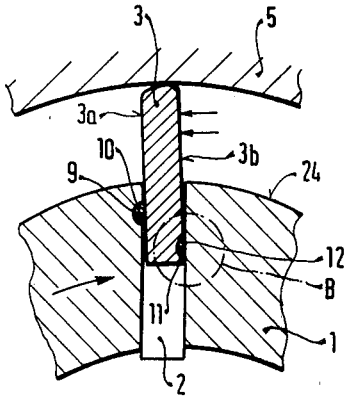
FIG. 6 is a cross-sectional view of a portion of a compressor which embodies the second embodiment of this invention.
Figure 7:
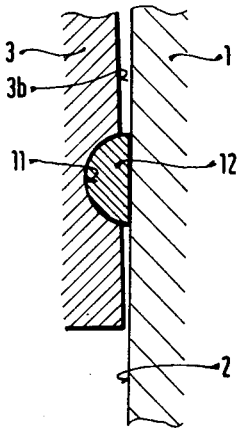
FIG. 7 is a detail view of that portion of FIG. 6 which is enclosed within a circle labelled B thereon.

In a similar fashion, as is shown in FIGS. 6 and 7, a leading groove 11 may be cut into the leading face 3*b* of the vane 3, and a similar leading bearing 12 may be introduced into the leading groove 11 to press between the vane 3 and the leading surface 2*b* of the slot. Although, as is shown in these Figures, the leading groove 11 is shown to be identical with trailing groove 9, and the leading bearing 12 is shown to be identical with trailing bearing 10, these relationships are not mandatory and the sizes of the bearings and grooves with respect to each other may be adjusted according to the needs of the user of the compressor.

Suitable material for the bearings includes sintered alloys, copper alloys, carbon, or any metal or metallic compound which does not require oil in order to serve as a bearing. Advantageously, the difference in width between each vane 3 and its corresponding slot 2 is chosen to be 0.01 millimeters at the smallest and 0.015 millimeters at the largest.

It will be understood that each of the elements described above, or two or more together, may also find a useful application in other types of constructions differing from the types described above.

While the invention has been illustrated and described as embodied in an improved rotor and mechanism for use in pumps, compressors and the like, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

We claim:

1. An improved mechanism for use in pumps, compressors and the like, comprising a rotor having an axis, a circumferential surface circulating around the axis and at least one slot extending inwardly from the surface, each such slot having a leading surface and a trailing surface which surfaces are flat and parallel to each other, the slot having an elongated trailing groove in each trailing surface extending parallel to the axis and having a cross-sectional shape taking on the shape of a segment of a circle having a chord which is smaller than a diameter of the circle;

a number of vanes equal to the number of slots, each vane being located within a corresponding slot in the rotor, with each vane being elongated parallel to the axis and having the shape of a rectangular parallelopiped with a leading face, a trailing face and rounded upper edges;

a number of trailing bearings equal to the number of slots and having the shape of an elongated bar with a cross-sectional shape taking on the shape of a semicircle of the circle, each trailing bearing resting within a corresponding trailing groove and being located between the rotor and the corresponding vane; and the leading face of each vane bearing an elongated leading groove extending parallel to the axis, the groove having the cross-sectional shape of a segment of a second circle with a chord which is smaller than the diameter of the second circle and further including a number of leading bearings equal to the number of slots, each leading bearing having the shape of an elongated bar with a cross-sectional shape taking on the shape of a semicircle of the second circle, each leading bearing resting within a corresponding vane and the rotor.

2. The mechanism defined by claim 1, wherein each trailing bearing is manufactured of a sintered alloy.

3. The mechanism defined by claim 1, wherein each trailing bearing is manufactured of a copper alloy.

4. The mechanism defined by claim 1, wherein each trailing bearing is manufactured of a carbon compound.

5. The mechanism defined by claim 1, wherein the leading bearings are identical to the trailing bearings and wherein the leading grooves are identical to the trailing grooves.

6. The mechanism defined by claim 1, wherein the segment is so chosen that the chord of the segment will be at least 0.003 millimeters distance from the diameter of the circle, when the circle and segment are superposed upon each other, with the chord and diameter being parallel.

* * * * *